US005740565A

United States Patent [19]

McDade

[11] Patent Number: 5,740,565

[45] Date of Patent: Apr. 21, 1998

[54] INFLATABLE SLEEPING BAG SYSTEM WITH NETTING MEMBER

[76] Inventor: John Patrick McDade, Trasna Island, Lisnaskea, Co. Fermanagh, Northern Ireland, BT92 OAJ

[21] Appl. No.: 812,357

[22] Filed: Mar. 5, 1997

[51] Int. Cl.[6] ..... A47G 9/08; A47C 27/10

[52] U.S. Cl. ..... 5/413 AM; 5/413; 135/96

[58] Field of Search ..... 5/413 AM, 413, 5/414, 416, 418, 710, 711; 135/96, 913

[56] References Cited

U.S. PATENT DOCUMENTS

| | | | |
|---|---|---|---|
| 3,751,741 | 8/1973 | Hendry | 5/413 AM |
| 3,860,980 | 1/1975 | Ebbert | 5/413 R |
| 4,232,692 | 11/1980 | Atkins | 5/418 |
| 5,471,687 | 12/1995 | Vierra | 5/413 AM |
| 5,640,725 | 6/1997 | Ando et al. | 5/413 AM |

FOREIGN PATENT DOCUMENTS

| | | | |
|---|---|---|---|
| 1376523 | 6/1963 | France | 5/413 AM |
| 2166343 | 5/1986 | United Kingdom | 5/413 AM |

*Primary Examiner*—Alexander Grosz

[57] ABSTRACT

A new Inflatable Sleeping Bag System for providing a combination inflatable mattress and sleeping bag providing a comfortable lightweight sleeping bag. The inventive device includes an inflatable mattress having a head support tube, a cover sheet having a zipper, insulation within the cover sheet, and a netting supported over the head support tube with a pair of support loops and support bar. The inflatable mattress includes at least one valve and a plurality of perforated dividers.

4 Claims, 3 Drawing Sheets

INFLATABLE SLEEPING BAG SYSTEM WITH NETTING MEMBER

BACKGROUND OF THE INVENTION

1. Field of the Invention

The present invention relates to Bed Devices and more particularly pertains to a new Inflatable Sleeping Bag System for providing a combination inflatable mattress and sleeping bag providing a comfortable lightweight sleeping bag.

2. Description of the Prior Art

The use of Bed Devices is known in the prior art. More specifically, Bed Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Bed Devices include U.S. Pat. No. 4,862,533; U.S. Pat. No. 4,091,482; U.S. Design Pat. No. 348,348; U.S. Pat. No. 3,877,092; U.S. Pat. No. 5,329,656 and U.S. Pat. No. 5,267,363.

While these devices fulfill their respective, particular objectives and requirements, the aformentioned patents do not disclose a new Inflatable Sleeping Bag System. The inventive device includes an inflatable mattress having a head support tube, a cover sheet having a zipper, insulation within the cover sheet, and a netting supported over the head support tube with a pair of support loops and support bar.

In these respects, the Inflatable Sleeping Bag System according to the present invention substantially departs from the conventional concepts and designs of the prior art, and in so doing provides an apparatus primarily developed for the purpose of providing a combination inflatable mattress and sleeping bag providing a comfortable lightweight sleeping bag.

SUMMARY OF THE INVENTION

In view of the foregoing disadvantages inherent in the known types of Bed Devices now present in the prior art, the present invention provides a new Inflatable Sleeping Bag System construction wherein the same can be utilized for providing a combination inflatable mattress and sleeping bag providing a comfortable lightweight sleeping bag.

The general purpose of the present invention, which will be described subsequently in greater detail, is to provide a new Inflatable Sleeping Bag System apparatus and method which has many of the advantages of the Bed Devices mentioned heretofore and many novel features that result in a new Inflatable Sleeping Bag System which is not anticipated, rendered obvious, suggested, or even implied by any of the prior art Bed Devices, either alone or in any combination thereof.

To attain this, the present invention generally comprises an inflatable mattress having a head support tube, a cover sheet having a zipper, insulation within the cover sheet, and a netting supported over the head support tube with a pair of support loops and support bar.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Inflatable Sleeping Bag System apparatus and method which has many of the advantages of the Bed Devices mentioned heretofore and many novel features that result in a new Inflatable Sleeping Bag System which is not anticipated, rendered obvious, suggested, or even implied by any of the prior art Bed Devices, either alone or in any combination thereof.

It is an object of the present invention to provide a new inflatable sleeping bag system which enables the user to sleep comfortably no matter how uneven the surface is on which the user is resting.

It is another object of the present invention to provide a new Inflatable Sleeping Bag System which may be easily and efficiently manufactured and marketed.

It is a further object of the present invention to provide a new Inflatable Sleeping Bag System which is of a durable and reliable construction.

An even further object of the present invention is to provide a new Inflatable Sleeping Bag System which is susceptible of a low cost of manufacture with regard to both materials and labor, and which accordingly is then susceptible of low prices of sale to the consuming public, thereby making such Inflatable Sleeping Bag System economically available to the buying public.

Still yet another object of the present invention is to provide a new Inflatable Sleeping Bag System which provides in the apparatuses and methods of the prior art some of the advantages thereof, while simultaneously overcoming some of the disadvantages normally associated therewith.

Still another object of the present invention is to provide a new Inflatable Sleeping Bag System for providing a combination inflatable mattress and sleeping bag providing a comfortable lightweight sleeping bag.

Yet another object of the present invention is to provide a new Inflatable Sleeping Bag System which includes an inflatable mattress having a head support tube, a cover sheet having a zipper, insulation within the cover sheet, and a netting supported over the head support tube with a pair of support loops and support bar.

Still yet another object of the present invention is to provide a new Inflatable Sleeping Bag System that prevents the coldness and dampness from the ground from reaching, the user.

Even still another object of the present invention is to provide a new Inflatable Sleeping Bag System that is lightweight for carrying upon camping or hiking trips.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
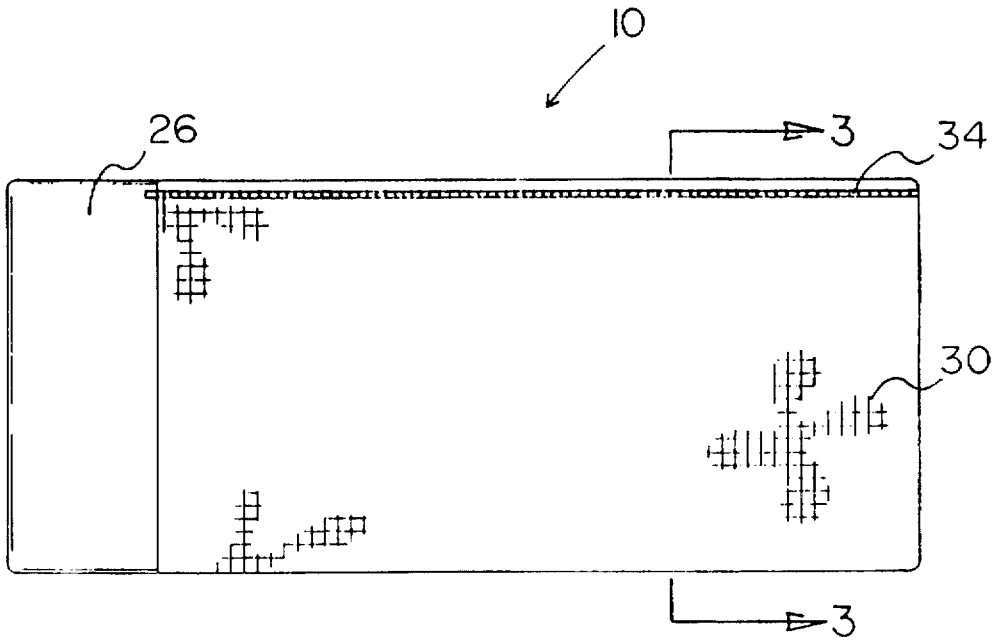
FIG. 1 is a top view of a new Inflatable Sleeping Bag System according to the present invention.

With reference now to the drawings, and in particular to FIGS. 1 through 6 thereof, a new Inflatable Sleeping Bag System embodying the principles and concepts of the present invention and generally designated by the reference numeral 10 will be described.

Figure 2:
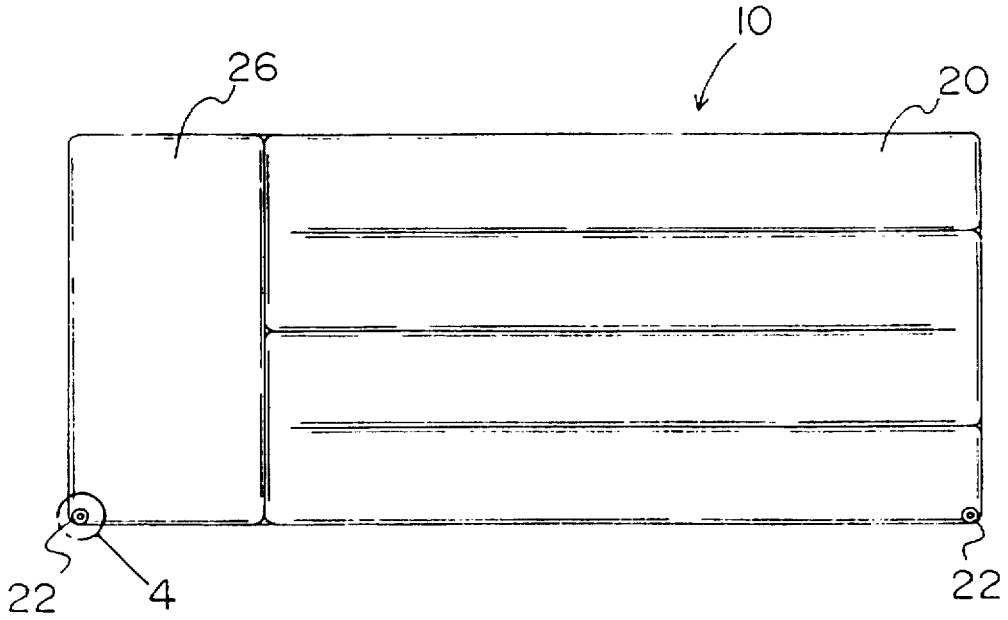
FIG. 2 is a bottom view of the present invention.
Figure 3:
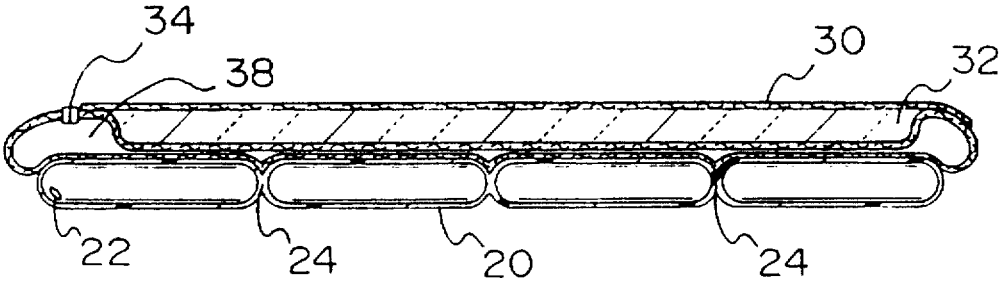
FIG. 3 is a cross sectional view taken along line 3—3 of FIG. 1.
Figure 4:
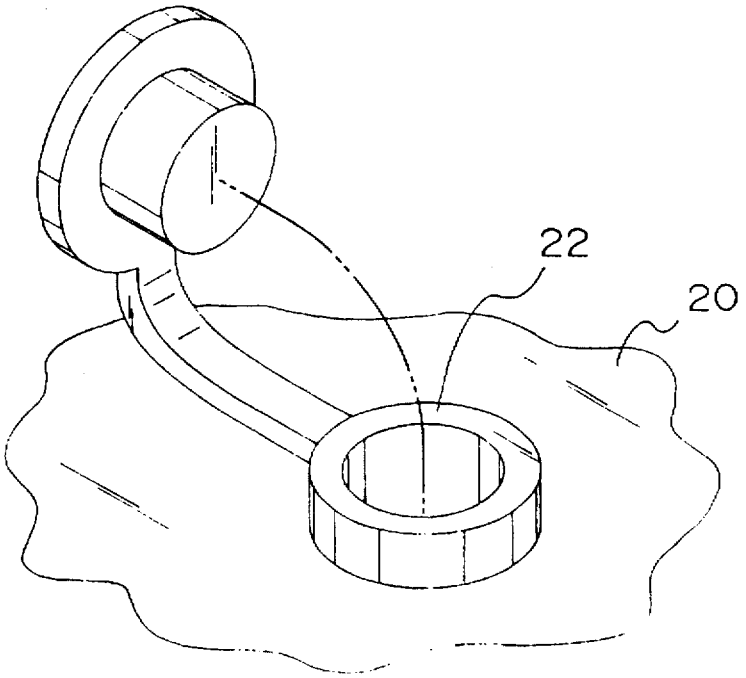
FIG. 4 is a magnified upper perspective view from FIG. 2 disclosing the air valve.

More specifically, it will be noted that the Inflatable Sleeping Bag System 10 comprises an elongated inflatable mattress 20 having a longitudinal axis and including at least one air valve 22 and having a top surface as shown in FIGS. 2 and 4 of the drawings. A cover sheet 30 has a zipper 34 for engaging opposite edges of the cover sheet 30 as best shown in FIG. 1 of the drawings. The cover sheet 30 is preferably breathable allowing fresh air into the cavity 38. The cover sheet 30 is secured juxtaposed to the top surface and forms a cavity 38 when the zipper 34 is engaged wherein a user may sleep comfortably as best shown in FIG. 3 of the drawings. The cover sheet 30 also has a layer of insulation 32 for retaining body heat within the cavity 38. The layer of insulation 32 is preferably only within an upper portion of the cover sheet 30 because the inflatable mattress 20 insulates the cavity 38 from underneath.

Figure 5:
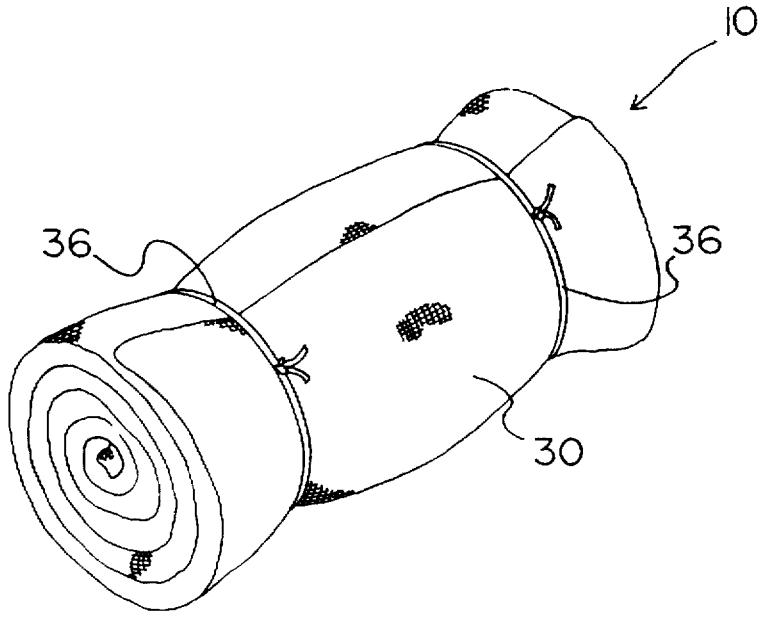
FIG. 5 is an upper perspective view of the present invention in the storage position.

As shown in FIGS. 1 and 2 of the drawings, a head support tube 26 is connected at an end of the inflatable mattress 20 for supporting a head of the user. The head support tube 26 receives air pressure from within the inflatable mattress 20 to maintain an inflated position. A plurality of perforated dividers 24 are secured traversely within the inflatable mattress 20 substantially parallel to the longitudinal axis for providing additional support as shown in FIG. 3 of the drawings. At least one strap 36 is secured to the cover sheet 30 for securing the present invention into a storage position substantially cylindrical when the inflatable mattress 20 and the head support tube 26 are deflated as best illustrated in FIG. 5 of the drawings.

Figure 6:
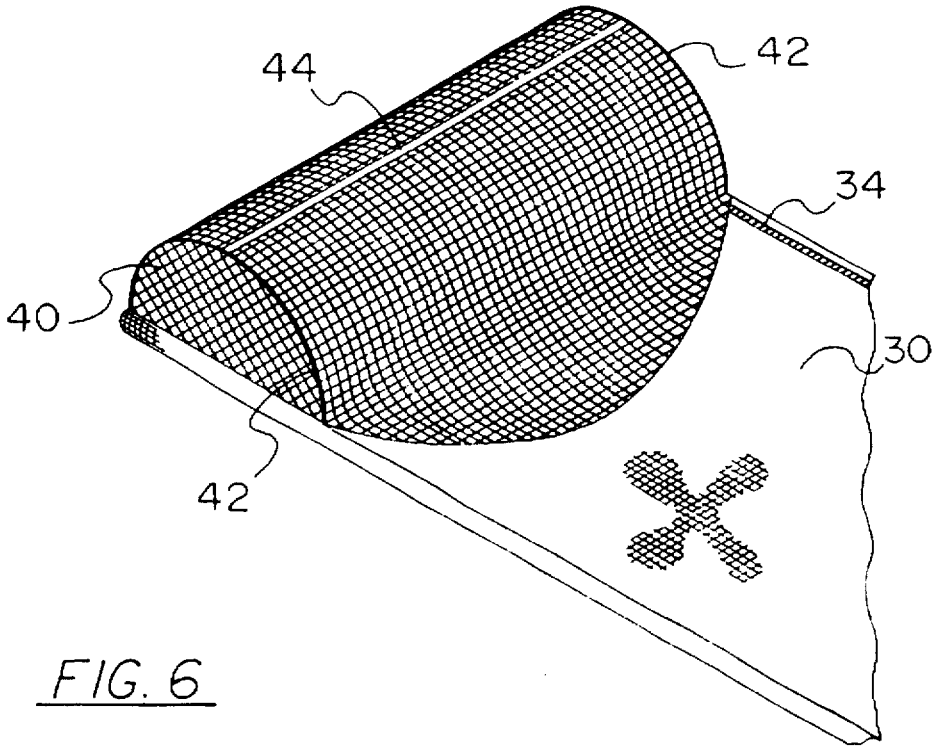
FIG. 6 is an upper view perspective of an alternative embodiment including a netting.

In an alternative embodiment as shown in FIG. 6 of the drawings, a pair of support loops 42 are secured opposite of one another to the head support tube 26 substantially parallel to the longitudinal axis. A netting 40 is secured mesial the support loops 42 for excluding debris and insects from within the cavity 38 during utilization by the user thereby increasing the comfort of the user. A support bar 44 is preferably secured mesial the support loops 42 traverse to the longitudinal axis for providing support of the netting 40.

In use, the user inflates the inflatable mattress 20 and the head support tube 26 by blowing into the air valves 22. The zipper 34 is thereafter opened allowing access to the cavity 38 whereby the user may position his or herself into for sleeping. The user, while within the cavity 38, closes the zipper 34 thereby enclosing the cavity 38. The inflatable mattress 20 and the head support tube 26 contain pressurized air which insulates the user from the coldness and dampness of the ground. In the alternative embodiment, the user is able to position himself or herself beneath the netting 40 thereby excluding insects and debris from within while simultaneously allowing the free exchange of air within the cavity 38 for the user to breath. When the user is finished utilizing the present invention, the air valves 22 are opened allowing the pressurized air to escape thereby deflating the inflatable mattress 20 and the head support tube 26. The inflatable mattress 20 and the cover sheet 30 are rolled into a cylindrical shape as shown in FIG. 5 where after the strap 36 is tied around the cylindrical shape thereby allowing the user to transport the present invention in a compact position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

I claim:

1. An inflatable sleeping bag system comprising:

an inflatable mattress having a pillow portion disposed from an end of a planar portion, the planar portion and the pillow portion being in fluid communication to form an air chamber, the mattress further having at least one sealable valve adapted to introduce air into the air chamber:

the planar portion further having a number of longitudinal dividers therein to provide structural support to the air chamber;

a cover flap disposed from the mattress along a first side of the mattress and a bottom side of the mattress, the cover flap having a distal edge corresponding to a second side of the mattress opposite the first side of the mattress;

a zipper detachably coupling the distal edge of the cover flap to the second side of the mattress whereby a cavity is formed;

a pair of semi-rigid support arches coupled to the mattress proximate the pillow portion, the support arches positioned opposite each other on the first and second sides of the mattress with their apexes spaced above the top surface of the mattress;

a netting member coupled to the mattress, the netting positionable over the support arches to prevent debris and fauna from entering the cavity.

2. The inflatable sleeping bag system of claim 1, including a support bar having ends, the support bar extending between the support arches, each support bar end coupled to the respective support arch proximate to an apex of the respective support arch.

3. The Inflatable Sleeping Bag System of claim 1, including at least one strap secured to said cover flap for securing the present invention into a substantially cylindrical storage position in the deflated condition of the mattress.

4. The Inflatable Sleeping Bag System of claim 3, wherein said cover flap is constructed of a breathable material such that fresh air can enter said cavity.

* * * * *